US005867993A

United States Patent [19]

Dubé

[11] Patent Number: 5,867,993

[45] Date of Patent: Feb. 9, 1999

[54] REFRIGERANT RESERVOIR AND HEAT EXCHANGER UNIT FOR A REFRIGERATED COUNTER SYSTEM

[76] Inventor: Serge Dubé, 2595 Bourgogne, St. Lazare, Quebec, Canada, J0P 1V0

[21] Appl. No.: 925,254

[22] Filed: Sep. 8, 1997

[51] Int. Cl.[6] ..... F25B 41/00

[52] U.S. Cl. ..... 62/81; 62/113; 62/513

[58] Field of Search ..... 62/113, 513, 81, 62/277, 278

[56] References Cited

U.S. PATENT DOCUMENTS

| | | | |
|---|---|---|---|
| 2,455,298 | 11/1948 | Cahenzli, Jr. | 62/513 |
| 2,577,598 | 12/1951 | Zwickl | 62/513 |
| 4,272,970 | 6/1981 | Hobbs | 62/513 |
| 4,621,501 | 11/1986 | Tanaka | 62/513 |
| 5,568,736 | 10/1996 | Nivens | 62/513 |

*Primary Examiner*—William E. Tapolcai
*Attorney, Agent, or Firm*—Carter & Schnedler, P.A.

[57] ABSTRACT

A refrigerant reservoir (23') and heat exchanger unit (25) for a refrigerated counter (11) and method of reducing compressor load and lowering energy consumption of the refrigerated counter system is described. The refrigerant reservoir (23') and heat exchanger unit (25) comprises a reservoir having a heat exchanger section provided with a cooling coil (26) to cool liquid refrigerant from a condenser (14) as it enters into the reservoir (23'). The reservoir is secured in a cooled area of a refrigerated counter (11). The outlet (31) of the reservoir feeds an expansion valve (29) where the pressure of the liquid refrigerant is lowered to further cool the liquid refrigerant. The expansion valve (29) has an outlet (28) which is connected to the inlet (17) of the cooling coil (26) whereby the cool refrigerant liquid in a feedback path, cools refrigerant entering the reservoir. The outlet (30) of the cooling coil (26) is connected to refrigerating coils (20') of a plurality of evaporators (20) which are associated with other refrigerated counters (11) as well as the one in which the unit is secured. The evaporator (20) cools the refrigerated counter (11) and thereby the reservoir (23') to sub-cool the refrigerant liquid therein and together with the heat exchanger (25) achieves an increase in load capacity, a pressure reduction at the inlet of the expansion valve (29) and a load reduction on associated compressors (12) to provide an energy reduction.

11 Claims, 2 Drawing Sheets

REFRIGERANT RESERVOIR AND HEAT EXCHANGER UNIT FOR A REFRIGERATED COUNTER SYSTEM

TECHNICAL FIELD

The present invention relates to a refrigerant reservoir and heat exchanger unit which is mounted within a refrigerated counter of a refrigeration system and capable of maintaining the refrigerant liquid at a sub-cooled temperature thereby providing a refrigerant liquid of reduced pressure at the inlet of the expansion valve and resulting in a compressor energy reduction.

BACKGROUND ART

In known refrigeration systems associated with refrigerated counters, liquid refrigerant from a condenser is fed to a reservoir which is usually maintained in the compressor room and a line from that reservoir feeds expansion valves associated with evaporators which are located within the refrigerated counters which are remote from the reservoir. As the refrigerant liquid travels from the reservoir to the expansion valve, it absorbs heat, although the convection lines are insulated. One can also imagine that if the reservoir is associated with a plurality of refrigerated counters, then several outlet lines are necessary to feed all of the expansion valves within the refrigerated counters. The compressors must therefore put out more energy to maintain an adequate pressure at the inlet of the expansion valve. Furthermore, the reservoir being in the environment of the compressors will absorb heat thereby reducing the temperature of the refrigerant and resulting in an increase of the compressor load. Accordingly, more energy is expensed to operate the refrigeration system.

SUMMARY OF INVENTION

It is a feature of the present invention to provide a refrigerant reservoir and heat exchanger unit which substantially overcomes the above-mentioned disadvantages of the prior art refrigerated counter systems.

Another feature of the present invention is to provide a refrigerant reservoir and heat exchanger unit which is mounted within a refrigerated area of a refrigerated counter whereby the cool air of the refrigerated counter will cool the gas within the reservoir.

Another feature of the present invention is to provide a refrigerant reservoir and heat exchanger unit and wherein the heat exchanger unit is provided with a cooling coil which is fed cooled refrigerant liquid from the outlet of the expansion valve associated therewith whereby to cool refrigerant gas before entering the reservoir from the condenser associated with the system.

Another feature of the present invention is to provide a refrigerant reservoir and heat exchanger unit capable of reducing the pressure of the gas fed to the expansion valve and accordingly resulting in a load reduction on associated compressors to provide an energy reduction and cost savings.

Another feature of the present invention is to provide a refrigerant reservoir and heat exchanger unit capable of feeding evaporators of two or more refrigerated counters.

Another feature of the present invention is to provide a method of reducing compressor load and thereby lowering energy consumption of a refrigerated counter system thereby overcoming the above-mentioned disadvantages of the prior art.

According to the above features, from a broad aspect, the present invention provides a refrigerant reservoir and heat exchanger unit for a refrigerated counter. The unit comprises a reservoir and a heat exchanger provided with a cooling coil to cool liquid refrigerant from a condenser means as it enters an inlet of the reservoir. The reservoir has an outlet to feed cooled liquid refrigerant to an inlet of an expansion valve where the pressure of the liquid refrigerant is lowered to further cool the liquid refrigerant. The expansion valve has an outlet connected to an inlet of the cooling coil. The cooling coil has an outlet connected to a refrigerating coil of an evaporator of a refrigerated counter. The evaporator cools the reservoir when secured in the refrigerated counter whereby to further cool the refrigerant liquid therein and together with the heat exchanger achieves increased load capacity and a pressure reduction at the inlet of the expansion valve and a load reduction on associated compressor(s) to provide an energy reduction.

According to a still further aspect of the present invention, there is provided a method of reducing compressor load thereby increasing load capacity and lowering energy consumption in a refrigerated counter system. The method comprises the steps of mounting in a refrigerated area of a refrigerated counter a refrigerant reservoir and heat exchanger unit. The heat exchanger unit is comprised of a cooling coil associated with a cooling section of the reservoir. A refrigerant is fed from a condenser means of the system to an inlet of the reservoir at the cooling section to cool the refrigerant. Cooled refrigerant is then fed from the reservoir to an inlet of an expansion valve to lower the pressure of the cooled refrigerant to further cool same. Cooled refrigerant from the expansion valve is then fed to an inlet of the cooling coil to cool the refrigerant from the condenser means as it enters the reservoir. One or more refrigerating coils of one or more evaporators associated with one or more refrigerated counters is fed cooled refrigerant liquid from said reservoir.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
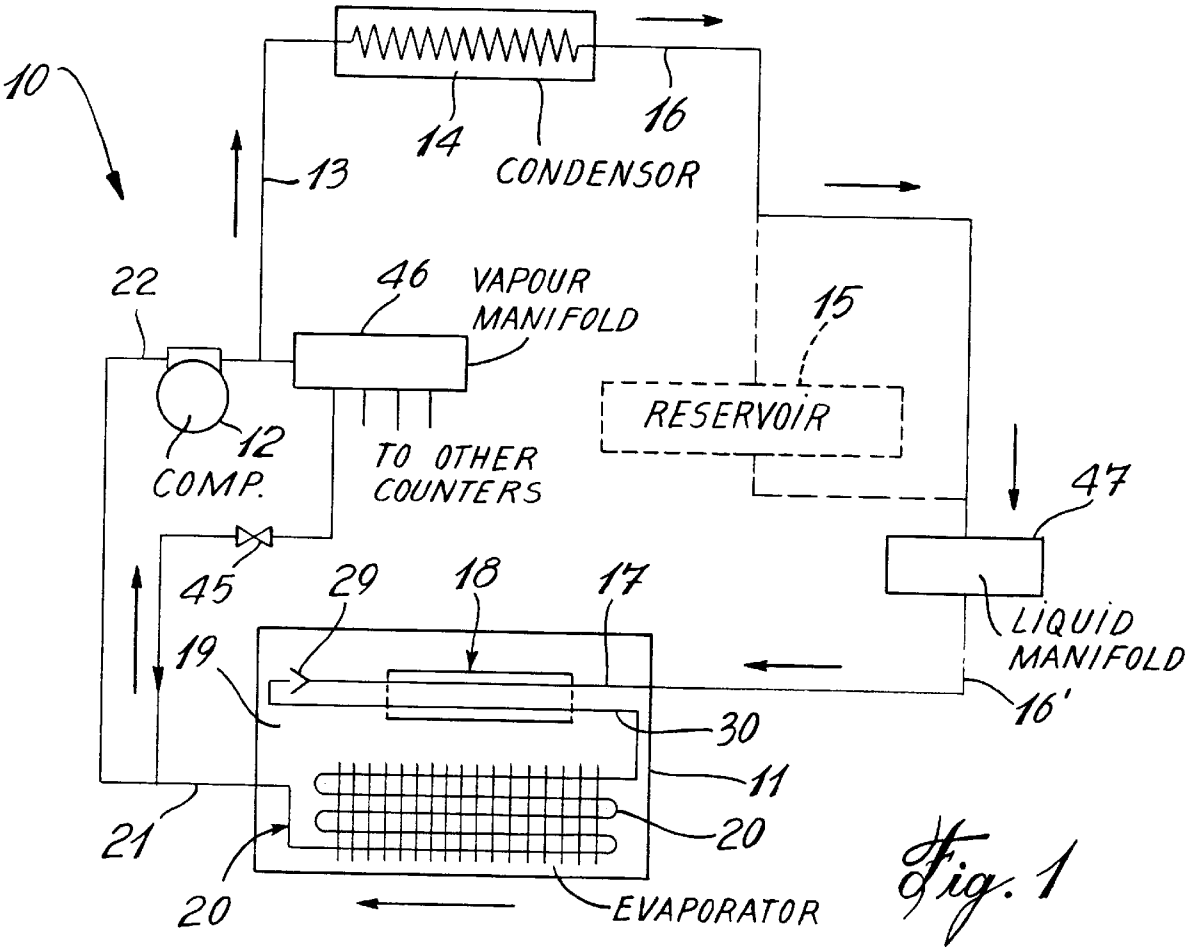
FIG. 1 is a simplified schematic diagram illustrating how the refrigerant reservoir and heat exchanger unit is integrated within a refrigerated counter of a refrigerating system.

Referring now to the drawings and more particularly to FIG. 1, there is shown generally at 10 a refrigerating system for a refrigerated counter 11 or a plurality of these counters 11 associated therewith. As hereinshown, the refrigerating system 10 is comprised of one or more compressors 12 which are connected through a line 13 to an associated condenser 14. The outlet of the condenser 14 is connected to a liquid manifold 47 which usually feeds an associated reservoir 15 mounted in the compressor room. This reservoir 15 is eliminated by the present invention, as shown by the dash line connections. Instead, the condenser outlet 16 and associated manifold outlet 16' feed the inlet 17 of the refrigerant reservoir and heat exchanger unit 18 of the present invention which is mounted in a refrigerated area 19 of the refrigerated counter 11. One or more evaporators 20 are secured in the refrigerated area 19 to provide the refrigeration of the counter. The outlet 21 of the evaporator 20 feeds the inlet 22 of the compressor 12 and the refrigerating cycle is complete.

Figure 2:
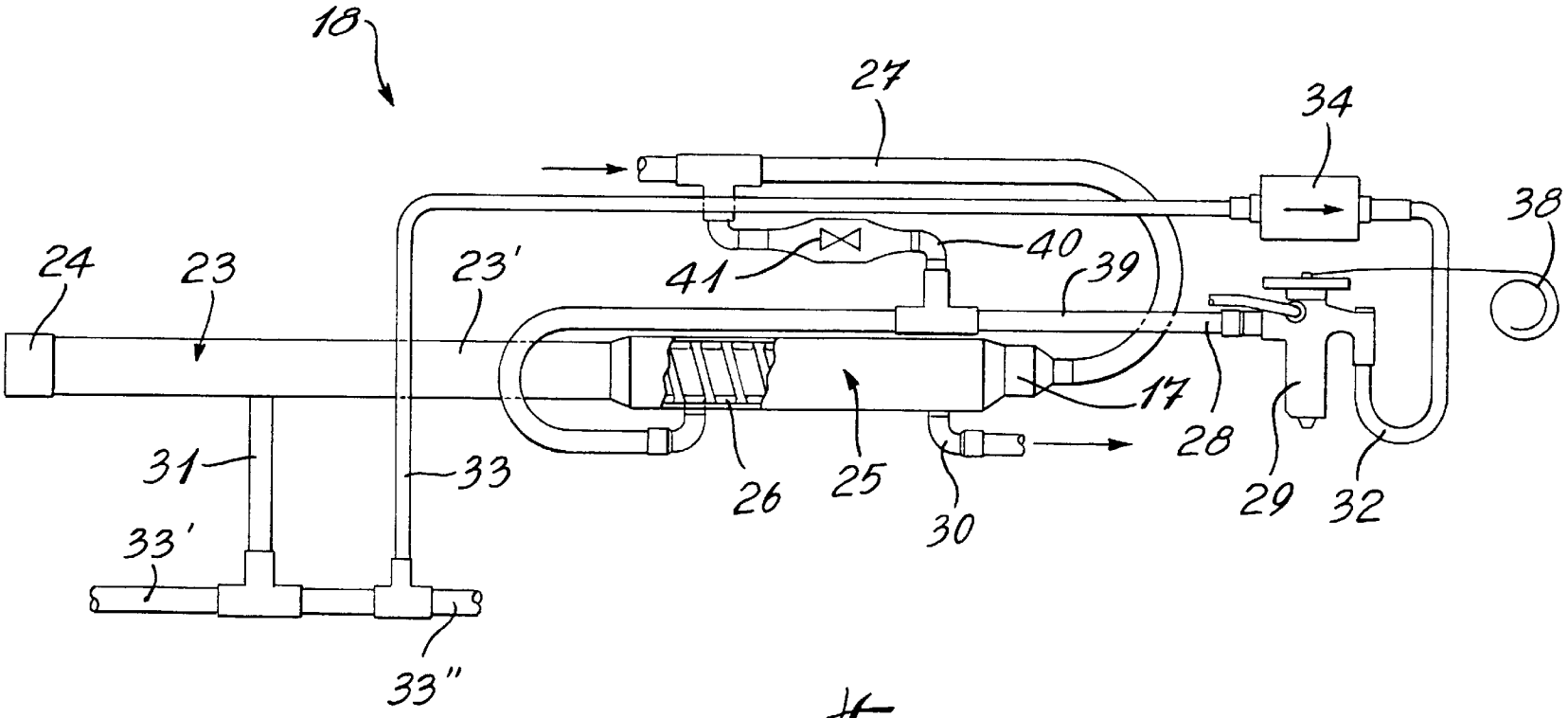
FIG. 2 is a side view showing the construction of the refrigerant reservoir and heat exchanger unit of the present invention.

With further reference to FIG. 2 there will now be described the construction of the refrigerant reservoir and heat exchanger unit 18 of the present invention. As hereinshown, the reservoir 23' of the unit 18 is comprised of an elongated tubular pipe 23 which is sealed at one end by an end cap 24 and the inlet 17 is provided at the opposed end. Adjacent the inlet 17 there is provided a heat exchanger 25 which is comprised of a cooling coil 26 disposed inside the pipe 23' for contact with the refrigerant liquid or liquid gas mixture which is fed to the inlet 17 by the feed pipe 27 which is connected to the outlet 16 of the condenser 14. The cooling coil 26 is fed cooled refrigerant gas from the outlet 28 of an expansion valve 29 associated therewith. This low pressure cooling gas is circulated about the heat exchanger section 25 and is outputted at the outlet 30 to feed the one or more evaporators 20 associated with the refrigerated counter 11. It may also feed several other associated refrigerated counters 11 and not shown herein.

As can be seen, the outlet 31 of the reservoir 23 feeds the inlet 32 of the expansion valve 29 through feed conduit 33. Other feed conduits 33' and 33" feed expansion valves associated with evaporators of other refrigerant counters (not shown), as above-mentioned.. A filter strainer device 34 is connected in the feed conduit 33 to filter the cooled liquid refrigerant. Because the cool refrigerant at the inlet 32 of the expansion valve is at low pressure, it reduces the load on the compressor or compressors 12 associated with the system 10. This translates in an energy reduction for the compressor and hence a cost saving. The refrigerant liquid at the outlet 28 of the expansion valve is fed back through the cooling coil 26 and into its associated evaporators 20. A bulb sensor 38 associated with the expansion valve 29 is connected to the outlet 21 of the evaporator 20 to sense the temperature of the outlet line.

A defrost conduit 40 provided with a check valve 41 therein is connected between the inlet 17 of the reservoir 23 and the inlet of the cooling coil 26 or at a convenient location along the pipe 39 connected between the inlet of the refrigerating coil and the outlet of the expansion valve. During the defrost cycle, the valve 45 is opened to connect the hot vapor gas form the defrost manifold 46 to the outlet 21 of the evaporator so as to defrost the evaporator. This hot gas is then fed back to the outlet 30 of the heat exchanger coil 26 to defrost the heat exchanger 25. The hot gas continues its travel through the defrost conduit 40 and back into the liquid manifold 47.

It can be seen that there is thus provided a very efficient refrigerating system for refrigerated counters and wherein the reservoir for the liquid refrigerant is located within one of the refrigerated counters associated with the system. Accordingly, the liquid refrigerant within the reservoir is maintained cool by the cool ambient air of the refrigerated counter, as well as by the cooling coil provided in the heat exchange section of the reservoir.

Summarizing there is provided a method of reducing compressor load and thereby lowering energy consumption in a refrigerated counter system. The method consists essentially of mounting in a refrigerated area of a refrigerated counter a refrigerant reservoir and heat exchanger unit 18. The heat exchanger unit 18 is comprised of a cooling coil 26 associated with a cooling section of the reservoir. Refrigerant from a condenser, such as condenser 14, as shown in FIG. 1 is fed to the inlet 17 of the reservoir 23 at the heat exchange section, to cool the refrigerant. The cool refrigerant from the reservoir is then fed to the inlet 32 of an expansion valve 29 which further lowers the pressure of the cooled refrigerant to sub-cool same and to feed the cooling coil in a feedback loop. The outlet of the cooling coil from the heat exchanger 25 then feeds one or more refrigerating coils of one or more evaporators 20 associated with one or more refrigerated counters 11. This translates in an increase in load capacity and a load reduction on the compressors 12 and hence an energy saving.

It is within the ambit of the present invention to cover any obvious modifications of the preferred embodiment described herein, provided such modifications fall within the scope of the appended claims.

I claim:

1. A refrigerant reservoir and heat exchanger unit for a refrigerated counter, said unit comprising a reservoir and a heat exchanger provided with a cooling coil to cool liquid refrigerant from a condenser means as it enters an inlet of said reservoir, said reservoir having an outlet to feed cooled liquid refrigerant to an inlet of an expansion valve where the pressure of said liquid refrigerant is lowered to further cool said liquid refrigerant, said expansion valve having an outlet connected to an inlet of said cooling coil, said cooling coil having an outlet connected to a refrigerating coil of an evaporator of a refrigerated counter, said evaporator cooling said reservoir when secured in said refrigerated counter whereby to further cool said refrigerant liquid therein and together with said heat exchanger maintaining said refrigerant liquid cool thereby achieving increased load capacity and a pressure reduction at said inlet of said expansion valve and a load reduction on associated compressor(s) to provide an energy reduction.

2. A refrigerant reservoir and heat exchanger unit as claimed in claim 1 wherein said condensor means comprises a condensor and associated liquid manifold.

3. A refrigerant reservoir and heat exchanger unit as claimed in claim 1 wherein said outlet of said reservoir is connected to said inlet of two or more expansion valves associated with respective evaporators of respective refrigerated counters.

4. A refrigerant and heat exchanger reservoir unit as claimed in claim 1 wherein said reservoir is constituted by an elongated tubular pipe sealed at one end and having said inlet of said reservoir at an opposed end.

5. A refrigerant and heat exchanger reservoir unit as claimed in claim 4 wherein said cooling coil is disposed about said tubular pipe adjacent said inlet of said reservoir.

6. A refrigerant and heat exchanger reservoir unit as claimed in claim 1 wherein there is further provided a defrost conduit connected between said inlet of said reservoir and said inlet of said cooling coil, and a check valve connected in said defrost conduit, said defrost conduit permitting hot gas to be fed through said heat exchanger from said cooling coil of said evaporator to defrost said heat exchanger and said evaporator.

7. A refrigerant and heat exchanger reservoir unit as claimed in claim 1 wherein a filter strainer device is connected to said inlet of said expansion valve to filter said refrigerant gas.

8. A refrigerant and heat exchanger reservoir unit as claimed in claim 3 wherein said reservoir is a sole reservoir associated with a refrigerating system comprising said compressor(s), said condenser means and said refrigerated counters with said evaporators; said cooled liquid gas in said reservoir being maintained substantially at the temperature of said refrigerated counter in which said unit is mounted.

9. A method of reducing compressor load thereby increasing load capacity and lowering energy consumption in a refrigerated counter system, said method comprising the steps of:

i) mounting in a refrigerated area of a refrigerated counter a refrigerant reservoir and heat exchanger unit, said heat exchanger unit having a cooling coil associated with a cooling section of said reservoir, ii) feeding refrigerant from a condenser means of said system to an inlet of said reservoir at said cooling section to cool said refrigerant, iii) feeding cooled refrigerant from said reservoir to an inlet of an expansion valve to lower the pressure of said cooled refrigerant to further cool same, iv) feeding cooled refrigerant from said expansion valve to an inlet of said cooling coil to cool said refrigerant from said condenser means as it enters said reservoir, and v) feeding one or more refrigerating coils of one or more evaporators associated with one or more refrigerated counters with cooled refrigerant liquid from said reservoir.

10. A method as claimed in claim 9 wherein said step (i) provides the step of cooling said refrigerant gas in said reservoir by cooled air of said refrigerated counter in which said reservoir is mounted.

11. A method as claimed in claim 10 wherein said steps (iii) and (iv) result in a compressor load reduction and the step of reducing energy cost of said system.

* * * * *